US011488505B2

(12) United States Patent
Piao et al.

(10) Patent No.: US 11,488,505 B2
(45) Date of Patent: Nov. 1, 2022

(54) DATA DRIVING DEVICE AND GAMMA VOLTAGE CIRCUIT FOR DRIVING PIXELS ARRANGED IN DISPLAY

(71) Applicant: SILICON WORKS CO., LTD., Daejeon (KR)

(72) Inventors: Taiming Piao, Daejeon (KR); Young Bok Kim, Daejeon (KR); Young Tae Kim, Daejeon (KR); Won Kim, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/110,060

(22) Filed: Dec. 2, 2020

(65) Prior Publication Data

US 2021/0183293 A1 Jun. 17, 2021

(30) Foreign Application Priority Data

Dec. 16, 2019 (KR) ..... 10-2019-0167533

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2330/028* (2013.01)

(58) Field of Classification Search
CPC ... G09G 2300/0819; G09G 2300/0852; G09G 2300/0861
See application file for complete search history.

(56) References Cited

U.S. PATENT DOCUMENTS

| | | | | |
|---|---|---|---|---|
| 8,581,824 | B2 | 11/2013 | Baek et al. | |
| 2006/0232520 | A1* | 10/2006 | Park | G09G 3/3291 345/76 |
| 2006/0232574 | A1* | 10/2006 | Miyazawa | G09G 3/3291 345/204 |
| 2010/0207967 | A1* | 8/2010 | Baek | H03M 1/687 341/144 |
| 2012/0113286 | A1* | 5/2012 | Lim | H04N 5/378 348/222.1 |
| 2012/0320098 | A1* | 12/2012 | Kwak | G09G 3/2003 345/690 |
| 2017/0085820 | A1* | 3/2017 | Inada | H04N 5/378 |
| 2017/0132975 | A1* | 5/2017 | Park | G09G 3/3241 |
| 2017/0243553 | A1* | 8/2017 | Kim | G09G 3/20 |
| 2018/0033368 | A1* | 2/2018 | Chaji | H05B 47/165 |
| 2018/0211605 | A1* | 7/2018 | Kim | G09G 3/3685 |
| 2019/0109599 | A1* | 4/2019 | Matsuzawa | H03M 1/123 |

FOREIGN PATENT DOCUMENTS

| | | |
|---|---|---|
| KR | 10-1603297 B1 | 3/2016 |
| KR | 10-1603302 B1 | 3/2016 |

* cited by examiner

*Primary Examiner* — Van N Chow
(74) *Attorney, Agent, or Firm* — Fenwick & West LLP

(57) ABSTRACT

An embodiment is disclosed that makes it possible to reduce the area of a digital-to-analog converter circuit by interpolating one reference voltage and generating a plurality of gamma voltages.

7 Claims, 6 Drawing Sheets

*FIG. 6*

| RGB | | | | Second voltage generating unit | | | | | Second selecting circuit |
|---|---|---|---|---|---|---|---|---|---|
| k(MSB) | | m(LSB) | | Vref2 | Vg | | | | Vdata |
| b3 | b2 | b1 | b0 | | Vg4 | Vg3 | Vg2 | Vg1 | |
| 0 | 0 | 0 | 0 | V2.5 | V4 | V3 | V2 | V1 | V1 |
| 0 | 0 | 0 | 1 | V2.5 | V4 | V3 | V2 | V1 | V2 |
| 0 | 0 | 1 | 0 | V2.5 | V4 | V3 | V2 | V1 | V3 |
| 0 | 0 | 1 | 1 | V2.5 | V4 | V3 | V2 | V1 | V4 |
| 0 | 1 | 0 | 0 | V6.5 | V8 | V7 | V6 | V5 | V5 |
| 0 | 1 | 0 | 1 | V6.5 | V8 | V7 | V6 | V5 | V6 |
| 0 | 1 | 1 | 0 | V6.5 | V8 | V7 | V6 | V5 | V7 |
| 0 | 1 | 1 | 1 | V6.5 | V8 | V7 | V6 | V5 | V8 |
| 1 | 0 | 0 | 0 | V10.5 | V12 | V11 | V10 | V9 | V9 |
| 1 | 0 | 0 | 1 | V10.5 | V12 | V11 | V10 | V9 | V10 |
| 1 | 0 | 1 | 0 | V10.5 | V12 | V11 | V10 | V9 | V11 |
| 1 | 0 | 1 | 1 | V10.5 | V12 | V11 | V10 | V9 | V12 |
| 1 | 1 | 0 | 0 | V14.5 | V16 | V15 | V14 | V13 | V13 |
| 1 | 1 | 0 | 1 | V14.5 | V16 | V15 | V14 | V13 | V14 |
| 1 | 1 | 1 | 0 | V14.5 | V16 | V15 | V14 | V13 | V15 |
| 1 | 1 | 1 | 1 | V14.5 | V16 | V15 | V14 | V13 | V16 |

DATA DRIVING DEVICE AND GAMMA VOLTAGE CIRCUIT FOR DRIVING PIXELS ARRANGED IN DISPLAY

CROSS REFERENCE TO RELATED APPLICATION

This application claims priority from Republic of Korea Patent Application No. 10-2019-0167533, filed on Dec. 16, 2019, which is hereby incorporated by reference in its entirety.

BACKGROUND

1. Field of Technology

The present embodiment relates to a technology for generating a gamma voltage for outputting image data in a data driving device of a display device.

2. Description of the Prior Art

A display device may include a panel, a gate driving device, a data driving device, and a timing controller. The data driving device may receive image data from a data processing device, may convert the image data into an analog signal (e.g., a data voltage), and may transmit the same to the panel.

The data driving device may include a digital-to-analog converter (DAC) that converts image data into an analog signal. The digital-to-analog converter may output one of gamma voltages as an analog signal according to image data.

The digital-to-analog converter may select and output one of a plurality of gamma voltages in response to image data having a specific number of bits. Thus, as the number of bits of the image data increases, the number of gamma voltages increases, and a number of elements for selecting the gamma voltages may be required. As the number of elements increases, the area occupied by the digital-to-analog converter in the data driving device may also increase.

For example, $2^{(n+1)}-2$ selecting elements may be required in order to process n bits of image data (n is a natural number of 1 or more). In the case of 10 bits of image data, 2046 elements may be required for each digital-to-analog converter.

SUMMARY

In this regard, the present embodiment is to provide a gamma voltage generation technology capable of reducing the area of the digital-to-analog converter while maintaining the existing image data processing capacity.

An objective of the present embodiment is to provide a technique for generating a plurality of gamma voltages by interpolating one reference voltage.

Another objective of the present embodiment is to provide a technique for generating a plurality of gamma voltages by supplying a bias current through current mirroring and using the mirrored current.

In order to attain the objectives described above, an embodiment provides a data driving device for driving pixels arranged in a display panel, which includes: a first selecting circuit configured to receive some bits of image data for driving the pixels and select one of a plurality of voltages included in a first gamma reference voltage as a second gamma reference voltage according to the some bits; a second voltage generating unit configured to generate a plurality of gamma voltages by increasing or reducing the second gamma reference voltage; and a second selecting circuit configured to receive the remaining bits of the image data and select one gamma voltage from among the plurality of gamma voltages as a data voltage for driving the pixels according to the remaining bits.

The data driving device may include a buffer configured to receive the one gamma voltage from the second selecting circuit, amplify the one gamma voltage, and output the amplified voltage as the data voltage.

In the data driving device, the second voltage generating unit may increase or reduce the second gamma reference voltage using a mirrored current.

The data driving device may further include a bias unit configured to supply a bias current to the second voltage generating unit by generating a reference current and mirroring the reference current to the second voltage generating unit.

In the data driving device, the bias unit may receive some of the plurality of voltages included in the first gamma reference voltage, and may generate the reference current through the received voltage.

In the data driving device, the second voltage generating unit may include a plurality of resistor arrays, may increase the second gamma reference voltage through one resistor array, and may reduce the second gamma reference voltage through another resistor array.

In the data driving device, the second gamma reference voltage may be applied to a node at which the one resistor array and the another resistor array meet.

Another embodiment provides a gamma voltage circuit for generating a gamma voltage for image data including k higher bits (k is a natural number) and m lower bits (m is a natural number), which includes: a resistor array including a plurality of resistors and nodes formed by the plurality of resistors connected between a high power voltage and a low power voltage, and configured to form node voltages at the nodes by distributing the high power voltage and the low power voltage to the plurality of resistors; a switching circuit configured to receive the node voltages and output one voltage selected from among the node voltages according to the k higher bits; a voltage generating circuit configured to receive the one selected voltage and generate a plurality of gamma voltages from the one selected voltage; and a bias unit including a bias resistor array configured to receive a first node voltage and a second node voltage from the resistor array and generate a current by a difference between the first node voltage and the second node voltage, and configured to mirror the current to the voltage generating circuit, wherein the voltage generating circuit may include a voltage generating resistor array for generating the plurality of gamma voltages, and is configured to increase or decrease the one selected voltage through a current mirrored by the bias unit and the voltage generating resistor array, thereby generating the plurality of gamma voltages.

In the gamma voltage circuit, the bias resistor array and the voltage generating resistor array may have the same characteristic.

In the gamma voltage circuit, the bias resistor array may have different characteristics from those of a part of the resistor array.

In the gamma voltage circuit, the bias resistor array may have different characteristic from those of a resistor connected between a first node at which the first node voltage is formed and a second node at which the second node voltage is formed.

In the gamma voltage circuit, wherein the bias unit may include a buffer configured to receive the first node voltage and the second node voltage and apply the same to the bias resistor array.

In the gamma voltage circuit, the buffer may apply the first node voltage and the second node voltage to both ends of the bias resistor array.

In the gamma voltage circuit, the voltage generating resistor array may include a higher resistor array configured to increase the one selected voltage and a lower resistor array configured to reduce the one selected voltage.

In the gamma voltage circuit, the one selected voltage may be applied to a node at which the higher resistor array and the lower resistor array meet.

As described above, according to the present embodiment, it is possible to reduce the number of selecting elements of the digital-to-analog converter, thereby reducing the area occupied by the digital-to-analog converter according thereto.

BRIEF DESCRIPTION OF THE DRAWINGS

The above and other aspects, features, and advantages of the present disclosure will be more apparent from the following detailed description taken in conjunction with the accompanying drawings, in which:

FIG. 6 is a table showing second gamma reference voltages, gamma voltages, and data voltages according to FIG. 5 according to an embodiment.

DETAILED DESCRIPTION

Figure 1:
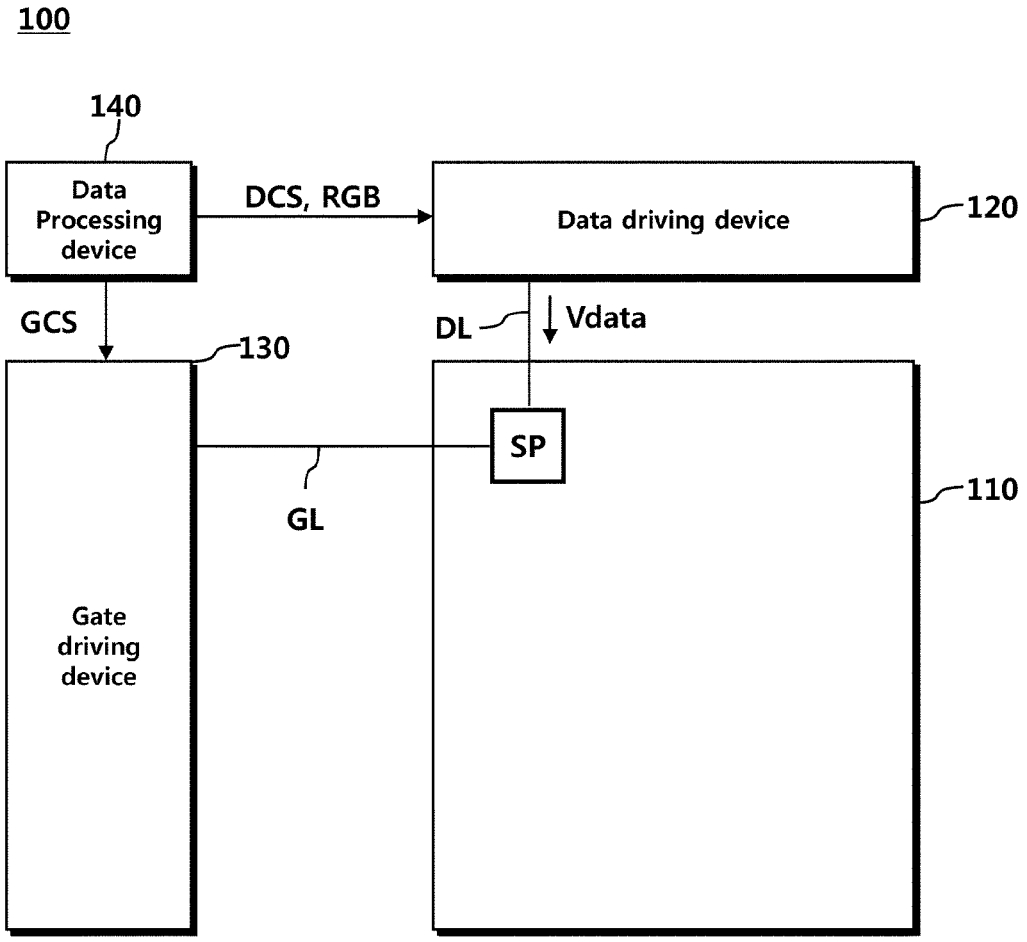
FIG. 1 is a block diagram of a display device according to an embodiment.

FIG. 1 is a block diagram of a display device according to an embodiment.

Referring to FIG. 1, the display device 100 may include a panel 110, a data driving device 120, a gate driving device 130, a data processing device 140, and the like.

The panel 110 may have a plurality of data lines DL and a plurality of gate lines GL arranged therein, and may have a plurality of pixels arranged therein. The pixel may include a plurality of subpixels SP. Here, the subpixels may be R (red), G (green), B (blue), W (white), and the like. One pixel may include subpixels SP of RGB, subpixels SP of RGBG, subpixels SP of RGBW, or the like. Hereinafter, for convenience of description, a description will be made on the assumption that one pixel includes subpixels of RGB.

The data driving device 120, the gate driving device 130, and the data processing device 140 generate signals for displaying an image on the panel 110.

The gate driving device 130 may supply a gate driving signal of a turn-on voltage or a turn-off voltage to the gate line GL. If a gate driving signal of a turn-on voltage is supplied to the subpixel SP, the subpixel SP is connected to the data line DL. In addition, if a gate driving signal of a turn-off voltage is supplied to the subpixel SP, the connection between the subpixel SP and the data line DL is disconnected. The gate driving device 130 may be referred to as a "gate driver".

The data driving device 120 may supply a data voltage Vdata to the subpixel SP through the data line DL. The data voltage Vdata supplied to the data line DL may be supplied to the subpixel SP according to the gate driving signal. The data driving device 120 may be referred to as a "source driver".

The data driving device 120 may generate a plurality of gamma voltages, and may output a data voltage Vdata corresponding to image data RGB, among the plurality of gamma voltages. The data driving device 120 may include a digital-to-analog converter and a buffer. The digital-to-analog converter may select one of the plurality of gamma voltages in response to image data RGB, and may output the one selected voltage to the buffer. The buffer may amplify the one selected voltage, and may supply the same to the data line DL.

The data driving device 120 may include at least one integrated circuit, and the at least one integrated circuit may be connected to a bonding pad of the panel 110 by a tape automated bonding (TAB) type or a chip-on-glass (COG) type, or may be formed directly on the panel 110, or, in some embodiments, may be formed to be integrated on the panel 110. In addition, the data driving device 120 may be implemented by a chip-on-film (COF) type.

The data processing device 140 may supply control signals to the gate driving device 130 and the data driving device 120. For example, the data processing device 140 may transmit a gate control signal GCS for initiating scanning to the gate driving device 130. In addition, the data processing device 140 may output image data RGB to the data driving device 120. In addition, the data processing device 140 may transmit, to each subpixel SP, a data control signal DCS for controlling the data driving device 120 to supply the data voltage Vdata. The data processing device 140 may be referred to as a "timing controller", and the data driving device 120 may be referred to as a "source driver".

Figure 2:
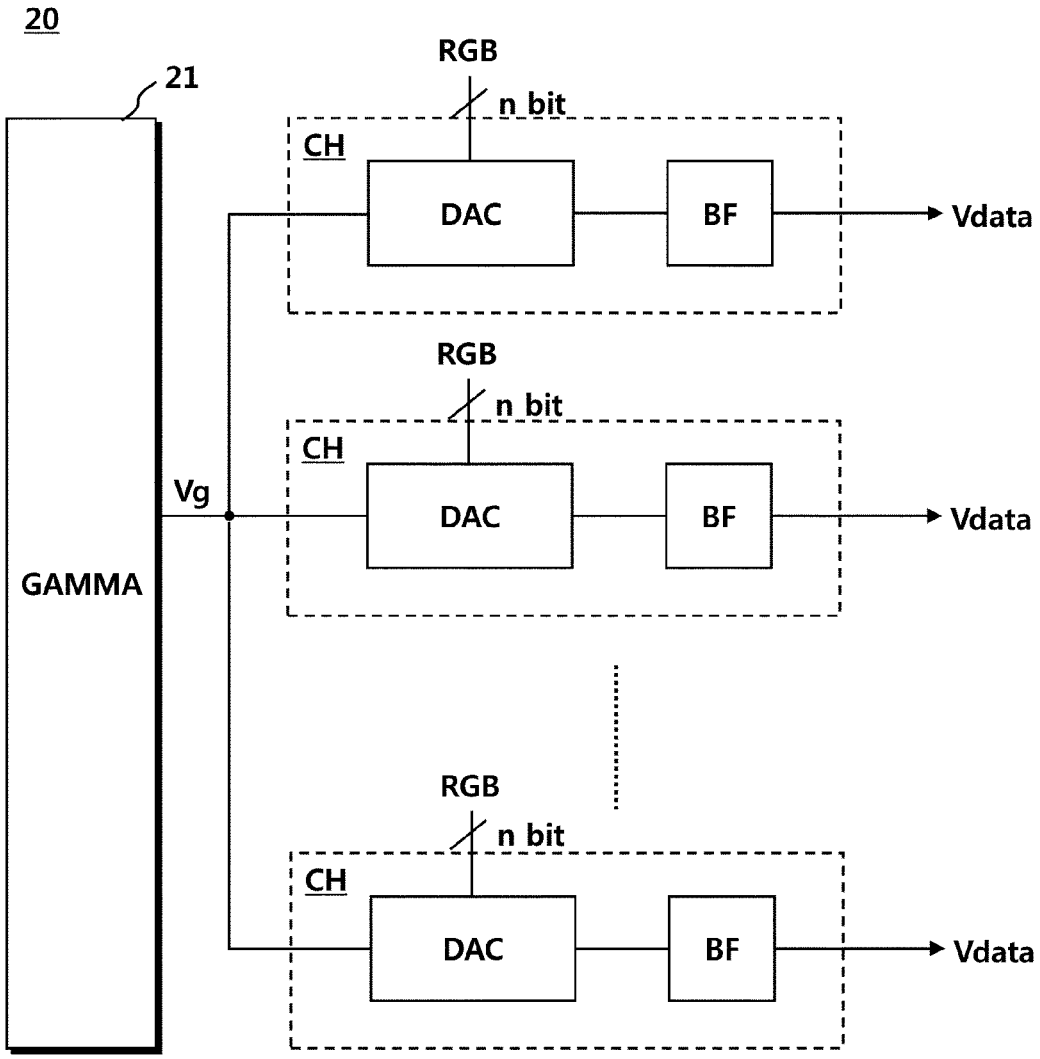
FIG. 2 is a block diagram of a data driving device according to an embodiment.

FIG. 2 is a block diagram of a general data driving device according to an embodiment.

Referring to FIG. 2, the data driving device 20 may include a gamma voltage circuit 21 and multiple channels CH. In addition, a digital-to-analog converter DAC and a buffer BF may be included in the channel CH.

The data driving device 20 may select one of the gamma voltages Vg, and amplify the selected voltage, thereby outputting a data voltage Vdata.

The gamma voltage circuit 21 may generate a gamma voltage Vg. The gamma voltage circuit 21 may receive two or more power voltages, may divide the two or more power voltages using a resistor array (also known as a "resistor string"), and may generate a gamma voltage Vg. A series of resistor arrays may be referred to as a "voltage divider". A plurality of resistors constituting a series of resistor arrays forms nodes at respective connection points, and a gamma voltage Vg may be formed at the nodes. Since the nodes are formed at the respective connection points of the plurality of resistors, the gamma voltage Vg may include a plurality of voltages.

The digital-to-analog converter DAC of each channel CH may generate a data voltage Vdata from the gamma voltage Vg. The digital-to-analog converter DAC may select one of the plurality of voltages included in the gamma voltage (Vg) in response to image data RGB. The digital-to-analog converter DAC may output the selected voltage as a data voltage Vdata. The digital-to-analog converter DAC may include a plurality of switching elements for selecting one of the plurality of voltages.

The gamma voltage Vg may include a plurality of voltages equal to the number of binary signals generated by the number of bits of the image data RGB. For example, if the data driving device 20 processes 8 bits (n=8) of image data RGB, the gamma voltage circuit 21 may generate a gamma voltage Vg including 256 ($2^8$) voltages. In addition, the digital-to-analog converter DAC may require 510 (=256×2−2) switching elements capable of selecting 256 voltages. If the number of bits of the image data RGB increases, the number of resistor arrays for generating the gamma voltage Vg and the number of switching elements for selecting the gamma voltage Vg may increase, thereby increasing the area occupied by the data driving device 20.

The buffer BF of each channel CH may receive and amplify the data voltage Vdata, and may apply the amplified data voltage Vdata to the data line.

Figure 3:
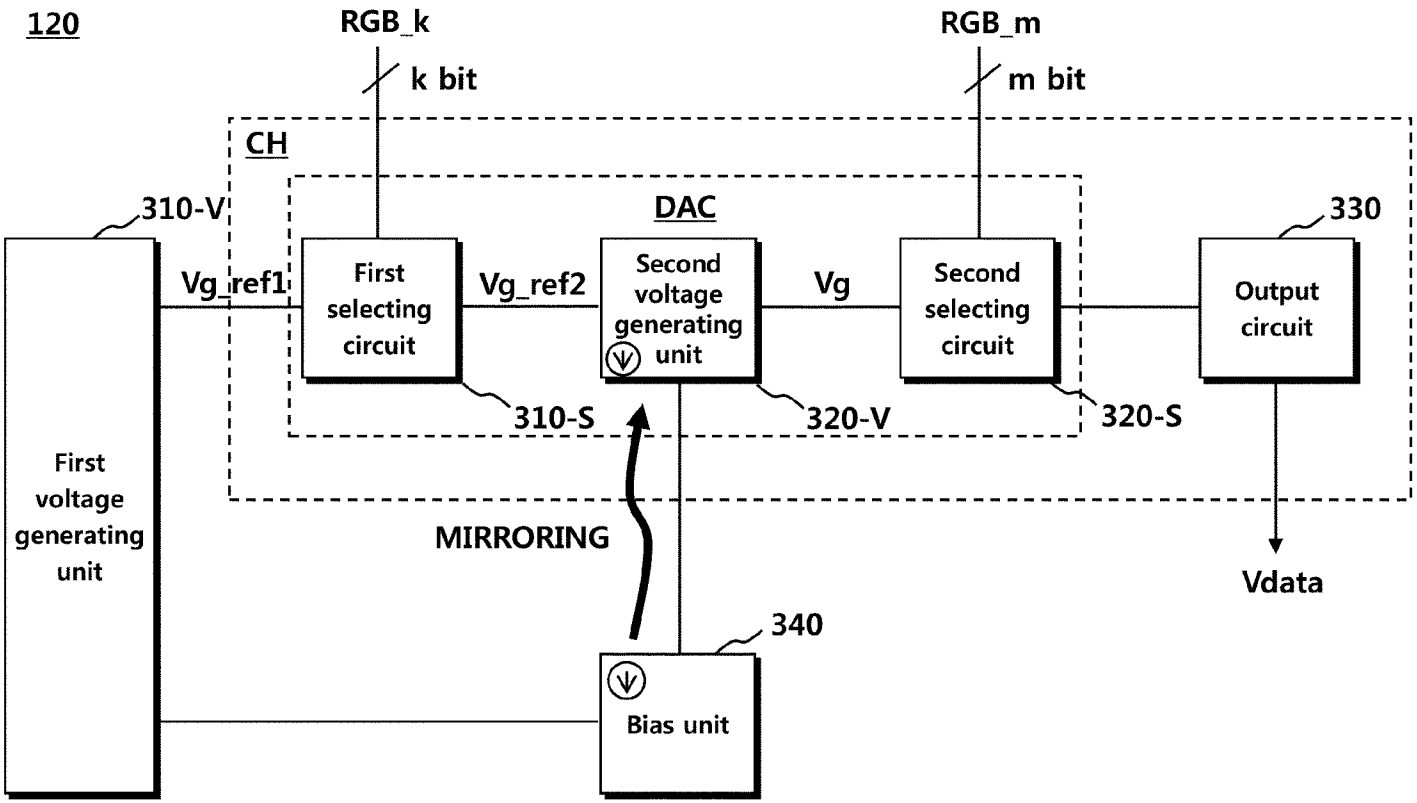
FIG. 3 is a block diagram of a data driving device according to an embodiment.

FIG. 3 is a block diagram of a data driving device according to an embodiment.

Referring to FIG. 3, a data driving device 120 according to an embodiment may include a first voltage generating unit 310-V, a first selecting circuit 310-S, a second voltage generating unit 320-V, a second selecting circuit 320-S, an output circuit 330, and a bias unit 340. Here, the first selecting circuit 310-S and the second selecting circuit 320-S may correspond to the digital-to-analog converters DAC.

The data driving device 120 may perform a voltage generating process several times in order to generate a data voltage Vdata. For example, the data driving device 120 may perform the first distribution of voltage of a high power voltage and a low power voltage during a first voltage generating process, thereby generating a first voltage. Subsequently, the data driving device 120 may perform changing of voltage on the first voltage (increase or reduce the voltage) during a second voltage generating process, thereby generating a second voltage. The data driving device 120 may generate and output a data voltage Vdata from the second voltage.

The first voltage generating unit 310-V may receive a high power voltage and a low power voltage, and may distribute the high power voltage and the low power voltage, thereby generating and outputting a first gamma reference voltage Vg_ref1. The first voltage generating unit 310-V may include a resistor array including a series of resistors for distribution of voltage.

The number of voltages generated by the first voltage generating unit 310-V through the distribution of voltage may be determined according to the bits of the image data RGB. For example, if n bits of image data RGB (n is a natural number of 1 or more) is processed, the total number of voltages generated by the first voltage generating unit 310-V may be $2^n$. The first voltage generating unit 310-V may output a plurality of voltages among the $2^n$ voltages as the first gamma reference voltage Vg_ref1.

The number of voltages included in the first gamma reference voltage Vg_ref1 may be determined according to the number of bits, among the image data RGB, which are received by the first selecting circuit 310-S. Since the first selecting circuit 310-S receives only some of the bits of the image data RGB, the number of voltages included in the first gamma reference voltage Vg_ref1 may also be determined according to some of the bits.

For example, n bits of image data RGB may include k bits of image data RGB_k and m bits of image data RGB_m. n=k+m, where "n", "k", and "m" may be natural numbers of 1 or more. If the first selecting circuit 310-S receives only k bits of image data RGB_k, the first gamma reference voltage Vg_ref1 may include $2^k$ voltages.

The first selecting circuit 310-S may select and output a second gamma reference voltage Vg_ref2 from the first gamma reference voltage Vg_ref1. For example, the first selecting circuit 310-S may include a switch array including a plurality of switches (e.g., transistors). Each of the switches may select one of the plurality of voltages included in the first gamma reference voltage Vg_ref1, and may output the one selected voltage as the second gamma reference voltage Vg_ref2.

The first selecting circuit 310-S may receive some of the bits of the image data RGB, and may select and output the second gamma reference voltage Vg_ref2 from the first gamma reference voltage Vg_ref1 in response to some of the bits. For example, if the first selecting circuit 310-S receives k bits of image data RGB_k, among k+m bits of image data RGB, the first selecting circuit 310-S may include $2^{(k+1)}-2$ switches. The first selecting circuit 310-S may select one of the $2^k$ voltages included in the first gamma reference voltage Vg_ref1.

The second voltage generating unit 320-V may receive the second gamma reference voltage Vg_ref2, and may generate and output a gamma voltage Vg including a plurality of voltages from the second gamma reference voltage Vg_ref2. The second voltage generating unit 320-V may receive the one voltage selected from the first gamma reference voltage Vg_ref1 as the second gamma reference voltage Vg_ref2, and may increase or reduce the second gamma reference voltage Vg_ref2, thereby generating and outputting a gamma voltage Vg including a plurality of voltages.

The second voltage generating unit 320-V may increase or reduce the second gamma reference voltage Vg_ref2 using a mirrored current in order to generate the gamma voltage Vg. The second voltage generating unit 320-V may output the increased voltage or the reduced voltage, as the gamma voltage Vg, to the second selecting circuit 320-S.

The second voltage generating unit 320-V may include a plurality of resistor arrays. The second voltage generating unit 320-V may increase the second gamma reference voltage Vg_ref2 through one resistor array, and may reduce the second gamma reference voltage Vg_ref2 through another resistor array.

Here, the second gamma reference voltage Vg_ref2 may be applied to the node at which one resistor array meets another resistor array. The one resistor array may generate an increased voltage of the second gamma reference voltage Vg_ref2 according to the mirrored current. The other resistor array may generate a reduced voltage of the second gamma reference voltage Vg_ref2 according to the mirrored current.

The bias unit 340 may generate a reference current, and may mirror the reference current to the second voltage generating unit 320-V, thereby supplying a bias current to the second voltage generating unit 320-V. The bias current may be supplied in the form of a mirrored current of the second voltage generating unit 320-V.

The bias unit 340 may receive some of the voltages obtained by dividing the high power voltage and the low power voltage from the first voltage generating unit 310-V, and may generate the reference current through the received voltage.

The second voltage generating unit 320-V may generate a gamma voltage Vg so as to include a plurality of voltages, and the number of voltages included in the gamma voltage Vg may be determined according to the number of bits received by the second selecting circuit 320-S, among the image data RGB. Since the second selecting circuit 320-S receives only some of the bits of the image data RGB, the number of voltages included in the gamma voltage Vg may also be determined according to some of the bits.

For example, n bits of image data RGB may include k bits of image data RGB_k and m bits of image data RGB_m. n=k+m, where "n", "k", and "m" may be natural numbers of 1 or more. If the second selecting circuit 320-S receives only m bits of image data RGB_m, the gamma voltage Vg may include $2^m$ voltages.

The second selecting circuit 320-S may receive the remaining bits, which are not received by the first selecting circuit 310-S, among the image data, and may select and output one of the plurality of voltages included in the gamma voltage Vg in response to the remaining bits in order to generate a data voltage for the image data.

The second selecting circuit 320-S may select and output the data voltage Vdata from the gamma voltage Vg. For example, the second selecting circuit 320-S may include a switch array including a plurality of switches (e.g., transistors). Each of the switches may select one of the plurality of voltages included in the gamma voltage Vg, and may output the one selected voltage as the data voltage Vdata.

For example, if the second selecting circuit 320-S receives m bits of image data RGB_m, among k+m bits of image data RGB, the second selecting circuit 320-S may include $2^{(m+1)}-2$ switches. The second selecting circuit 320-S may select one of the $2^m$ voltages included in the the gamma voltage Vg.

The output circuit 330 may amplify the data voltage Vdata, and may apply the same to the data line. The output circuit 330 may include a buffer for amplifying the data voltage Vdata.

Figure 4:
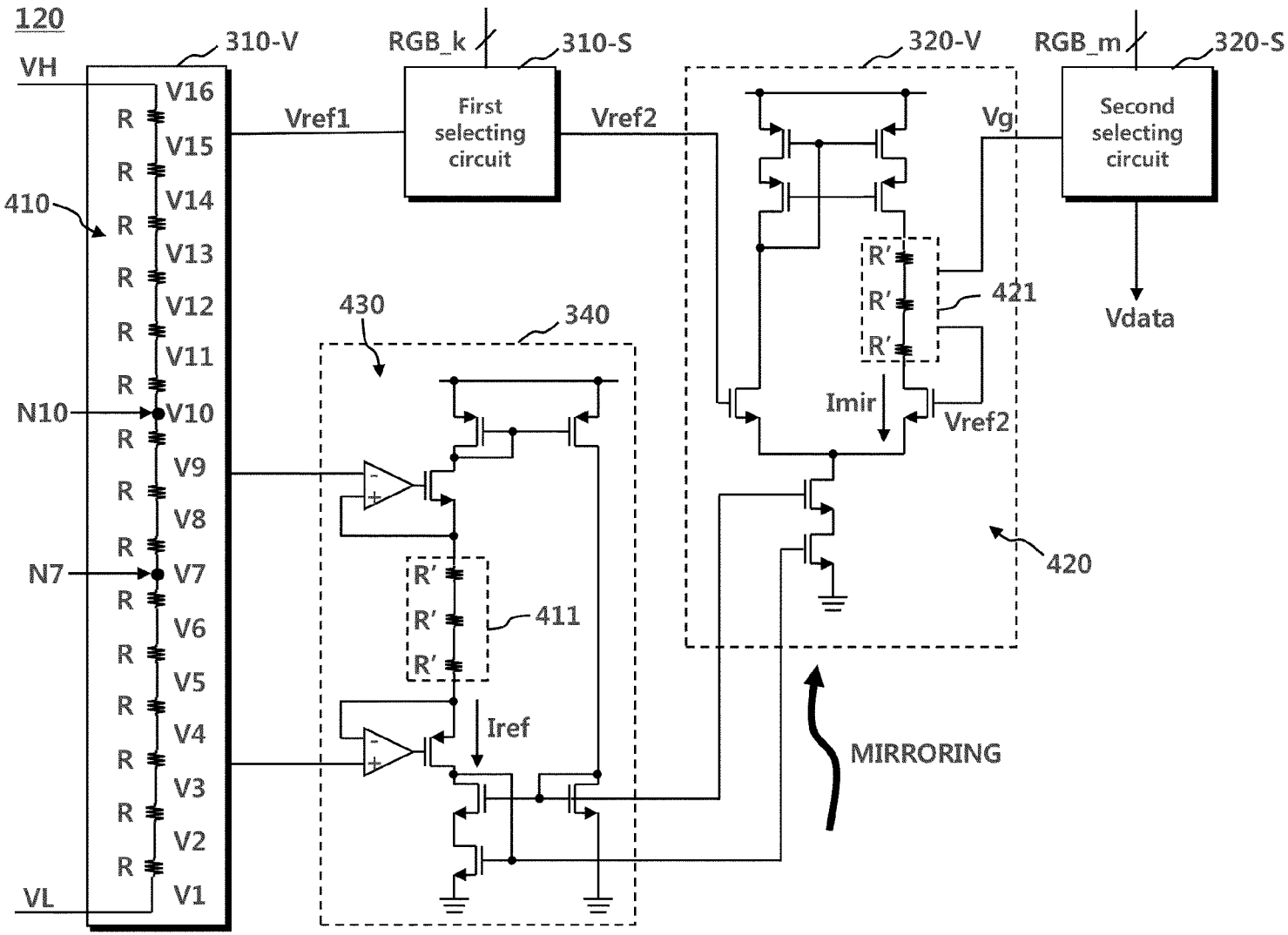
FIG. 4 is a circuit diagram of a data driving device according to an embodiment.

FIG. 4 is a circuit diagram of a data driving device according to an embodiment.

Referring to FIG. 4, the circuits of a first voltage generating unit 310-V, a second voltage generating unit 320-V, and a bias unit 340 of the data driving device 120 are illustratesd.

Although the gamma voltage Vg may include voltages having different polarities, a description will be made below on the assumption that the gamma voltage Vg includes only positive voltages.

The first voltage generating unit 310-V may include a resistor array 410. The resistor array 410 may include a plurality of resistors connected to each other in series. In addition, the resistor array 410 may include nodes formed by a plurality of resistors connected between a high power voltage VH and a low power voltage VL. The node may include a point at which a resistor meets another resistor, an end of a resistor to which a high power voltage VH is applied, or an end of a resistor to which a low power voltage VL is applied. In FIG. 4, the values of resistors included in the first voltage generating unit 310-V may be expressed as "R".

The resistor array 410 may distribute the high power voltage VH and the low power voltage VL to a plurality of resistors in series, thereby forming a node voltage at each note. The number of node voltages may vary depending on the number of bits of the image data RGB.

For example, if the image data RGB has 4 bits, the resistor array 410 may generate 16 node voltages V1 to V16, and may include 15 resistors connected to each other in series therefor. Since the high power voltage VH and the low power voltage VL must be divided by the resistors, the resistors may have the same resistance value R.

The first voltage generating unit 310-V may output some of the 16 node voltages V1 to V16 as the first gamma reference voltage Vg_ref1. The voltage output from the first voltage generating unit 310-V may differ depending on the number of bits, among the image data RGB, received by the first selecting circuit 310-S. The number of node voltages output to the first gamma reference voltage Vg_ref1 may vary depending on the number of bits of the image data RGB received by the first selecting circuit 310-S.

For example, if the k bits of image data RGB_k received by the first selecting circuit 310-S have 1 bit, the first voltage generating unit 310-V may output two node voltages as the first gamma reference voltage Vg_ref1. If the k bits of image data RGB_k received by the first selecting circuit 310-S have 2 bits, the first voltage generating unit 310-V may output 4 node voltages as the first gamma reference voltage Vg_ref1.

The first selecting circuit 310-S may receive the first gamma reference voltage Vg_ref1, and may output the second gamma reference voltage Vg_ref2. The first selecting circuit 310-S may select only one node voltage from among the node voltages received, as the first gamma reference voltage Vg_ref1, from the first voltage generating unit 310-V. The first selecting circuit 310-S may include a switch circuit in order to select only one node voltage. The first selecting circuit 310-S may include a number of switches corresponding to k bits of image data RGB_k to be received. The first selecting circuit 310-S may select, as the second gamma reference voltage Vg_ref2, only one node voltage from among the node voltages received, as the first gamma reference voltage Vg_ref1, through the switches.

The second voltage generating unit 320-V may include a voltage generating circuit 420. The voltage generating circuit 420 may receive the second gamma reference voltage Vg_ref2, and may generate a gamma voltage Vg from the second gamma reference voltage Vg_ref2. The gamma voltage Vg may include a plurality of voltages.

The voltage generating circuit 420 may include a resistor array 421. The resistor array 421 may receive the second gamma reference voltage Vg_ref2, and may generate a gamma voltage Vg using the second gamma reference voltage Vg_ref2 and the current Imir passing through the resistor array 421. The resistor array 421 may increase or reduce the second gamma reference voltage Vg_ref2, thereby generating a plurality of voltages, and the gamma voltage Vg may include the plurality of generated voltages.

The current Imir may be supplied from the bias unit 340. The bias unit 340 may mirror a reference current Iref to the voltage generating circuit 420 of the second voltage generating unit 320-V, thereby supplying the current Imir.

The second selecting circuit 320-S may receive a gamma voltage Vg from the second voltage generating unit 320-V. The second selecting circuit 320-S may select one of a plurality of voltages included in the gamma voltage Vg in response to m bits of image data RGB_m. Like the first selecting circuit 310-S, the second selecting circuit 320-S may also include switches corresponding to the m bits of image data RGB_m, and each of the switches may select one of the plurality of voltages included in the gamma voltage Vg.

The bias unit 340 may include a bias circuit 430. The bias circuit 430 may receive a plurality of node voltages from the resistor array 410. For example, in the case of 4 bits of image data RGB, the bias circuit 430 may receive two node voltages among 16 node voltages V1 to V16. The received node voltages may be input to a buffer, and may then be applied to both ends of the resistor array 411.

The bias circuit 430 may include a resistor array 411 for generating a current by the voltage difference between a plurality of received node voltages. The current generated by the resistor array 411 may be referred to as a "reference current Iref". The bias circuit 430 may mirror the reference current Iref to the resistor array 421 of the voltage generating circuit 420. The mirrored reference current Iref may be used for the voltage generating circuit 420 to increase or reduce the second gamma reference voltage Vg_ref2.

Here, the resistor array 411 of the bias circuit 430 may have the same characteristic as those of the resistor array 421 of the second voltage generating unit 320-V. Both of the resistor arrays 411 and 421 may include the same number of resistors. In addition, the resistors constituting both of the resistor arrays 411 and 421 may have the same resistance value. For example, the resistor array 411 of the bias circuit 430 and the resistor array 421 of the second voltage generating unit 320-V may include three resistors, respectively, and each of the resistors may have a value R'.

In addition, the resistor array 411 of the bias circuit 430 may differ from a part of the resistor array 410 in the characteristics thereof. The resistor array 411 of the bias circuit 430 may differ from a part of the resistor array 410 in the number of resistors therein. In addition, the resistor array 411 of the bias circuit 430 may differ from a part of the resistor array 410 in the resistance value between the resistors constituting the same. For example, the resistance values of the resistors constituting a part of the resistor array 410 may be R, and the resistance values of the resistors constituting the resistor array 411 of the bias circuit 430 may be R, which are different from each other.

Here, the resistor array 411 of the bias circuit 430 may have different characteristics from those of the resistor between the nodes at which the voltages input from the resistor array 410 to the bias circuit 430 are formed. For example, if a $7^{th}$ node voltage V7 and a $10^{th}$ node voltage V10 are inputted to the bias circuit 430, the resistor array 411 may have different characteristics from those of the resistor between the $7^{th}$ node and the $10^{th}$ node of the resistor array 410. Three resistors between the $7^{th}$ node and the $10^{th}$ node of the resistor array 410 may have a resistance value R, whereas three resistors of the resistor array 411 may have a resistance value R.

Figure 5:
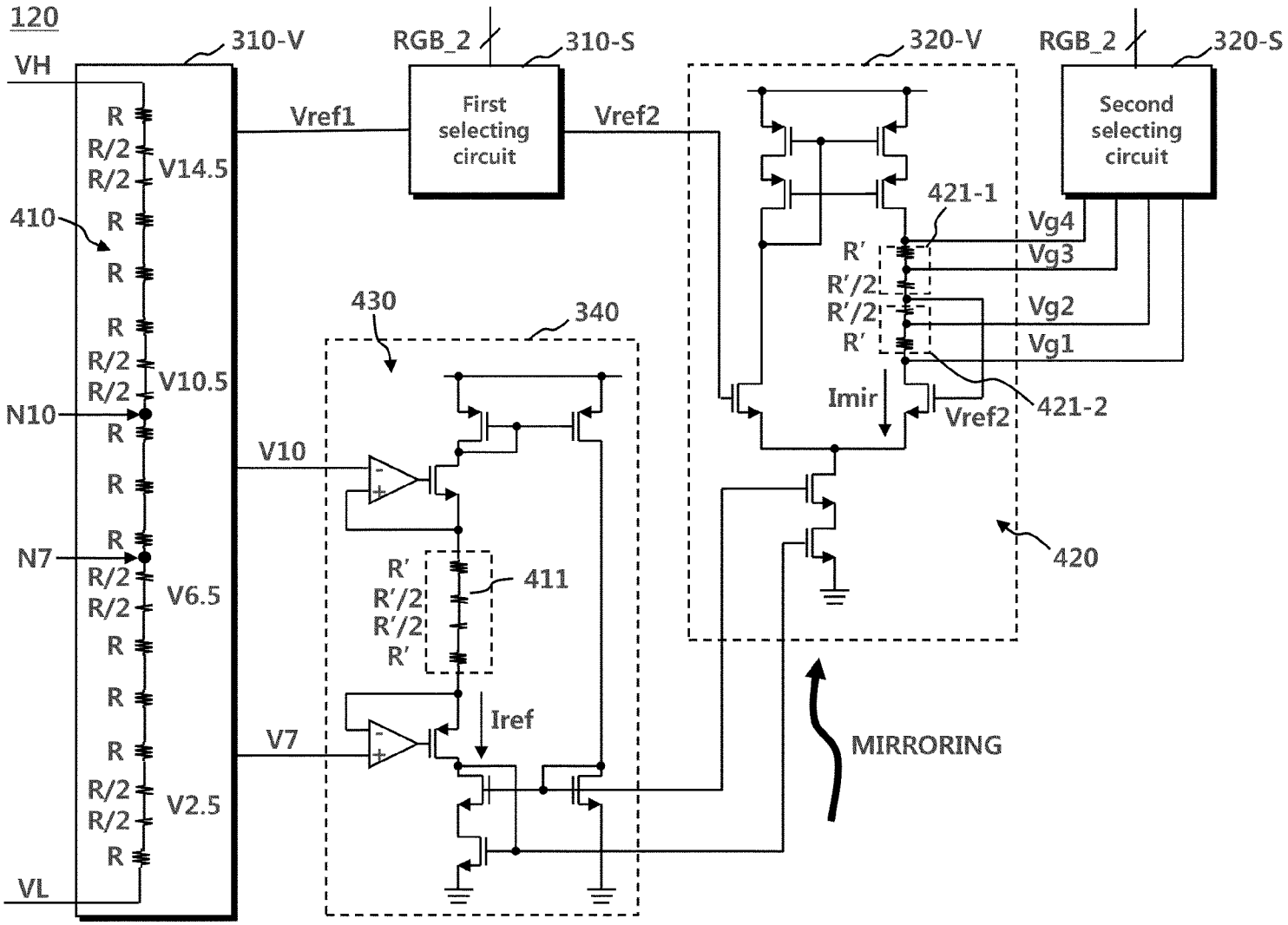
FIG. 5 is a diagram illustrating an example of the operation of a data driving device for 4 bits of image data according to an embodiment.

FIG. 5 is a diagram illustrating an example of the operation of a data driving device for 4 bits of image data according to an embodiment, and FIG. 6 is a table showing second gamma reference voltages, gamma voltages, and data voltages according to FIG. 5.

Referring to FIG. 5, the configuration of a circuit in which the data driving device 120 processes 4 bits of image data RGB is illustrated. The first selecting circuit 310-S may perform selection in response to 2 bits of image data RGB_2, among the 4 bits of image data RGB, and the second selecting circuit 320-S may perform selection in response to the remaining 2 bits of image data RGB_2.

The first voltage generating unit 310-V may output node voltages corresponding to 2 bits, among the 16 node voltages V1 to V16, as the first gamma reference voltage Vg_ref2. The first gamma reference voltage Vg_ref1 may include a node voltage of 2.5V (V2.5), a node voltage of 6.5V (V6.5), a node voltage of 10.5V (V10.5), and a node voltage of 14.5V (V14.5).

Meanwhile, the bias circuit 430 of the bias unit 340 may receive a plurality of node voltages from the resistor array 410 of the first voltage generating unit 310-V. For example, the input voltages may include a node voltage of 7V (V7) and a node voltage of 10V (V10). Here, the resistor array 411 of the bias circuit 430 may have different characteristics from those of the resistor between the $7^{th}$ node N7 and the $10^{th}$ node N10. Since the resistor array 411 of the bias circuit 430 may have the same resistor characteristic as the resistor array 421 of the voltage generating circuit 420, the resistor array 421 of the voltage generating circuit 420 may also have different characteristics from those of the resistor between the $7^{th}$ node N7 and the $10^{th}$ node N10.

For example, the resistor structure between the $7^{th}$ node N7 and the $10^{th}$ node N10 has a serial connection of three resistors having a resistance value R, whereas the resistor array 411 of the bias circuit 430 and the resistor array 421 of the voltage generating circuit 420 may have a serial connection of four resistors having a resistance value R' or R/2.

The first selecting circuit 310-S may select only one voltage from among the first gamma reference voltage Vg_ref1. For example, the first selecting circuit 310-S may select V2.5 as the second gamma reference voltage Vg_ref2. The first selecting circuit 310-S may transmit V2.5 to the voltage generating circuit 420 of the second voltage generating unit 320-V.

If V2.5 is input to the second voltage generating unit 320-V, V2.5 may be applied to the resistor array 421 at the opposite side. Here, the resistor array 421 generating the gamma voltage Vg may include a higher resistor array 421-1 for increasing a specific voltage and a lower resistor array 421-2 for reducing a specific voltage. The second gamma reference voltage Vg_ref2 may be applied to the node at which the higher resistor array 421-1 and the lower resistor array 421-2 of the resistor array 421 meet.

The higher resistor array 421-1 may increase V2.5 applied as the second gamma reference voltage Vg_ref2, and may generate a third gamma voltage Vg3 of 3V and a fourth gamma voltage Vg4 of 4V. On the other hand, the lower resistor array 421-2 may reduce V2.5 applied as the second gamma reference voltage Vg_ref2, and may generate a second gamma voltage Vg2 of 2V and a first gamma voltage Vg1 of 1V. The higher resistor array 421-1 and the lower resistor array 421-2 may generate the first to fourth gamma voltages Vg1 to Vg4 using the current Imir mirrored by the bias unit 340.

The second selecting circuit 320-S may select one of the first to fourth gamma voltages Vg1 to Vg4 as a data voltage Vdata in response to 2 bits of image data RGB_2. The second selecting circuit 320-S may transmit the selected voltage to the buffer.

Referring to FIG. 6, the illustrated table shows second gamma reference voltages Vg_ref2, gamma voltages Vg, and data voltages Vdata, which are generated when 4 bits of image data RGB are processed by the first and second selecting circuits 310-S and 320-S by 2 bits, respectively. The k bits of image data RGB_k processed by the first selecting circuit 310-S may be defined as a most significant bit (MSB), and may be 2 bits in this example. The m bits of image data RGB_m processed by the second selecting circuit 320-S may be defined as a least significant bit (LSB), and may be 2 bits in this example.

Accordingly, if image data RGB is 0000, 0001, 0010, and 0011, the second gamma reference voltage Vg_ref2 may be V2.5, and V1, V2, V3, and V4 may be generated as the gamma voltage Vg. The second selecting circuit 320-S may output V1, V2, V3, and V4 according to bit signals of image data RGB of 0000, 0001, 0010, and 0011, respectively.

Likewise, if image data RGB is 0100, 0101, 0110, and 0111, the second gamma reference voltage Vg_ref2 may be V6.5, and V5, V6, V7, and V8 may be generated as the gamma voltage Vg. The second selecting circuit 320-S may output V5, V6, V7, and V8 according to bit signals of image data RGB of 0100, 0101, 0110, and 0111, respectively.

If image data RGB is 1000, 1001, 1010, and 1011, the second gamma reference voltage Vg_ref2 may be V10.5, and V9, V10, V11, and V12 may be generated as the gamma voltage Vg. The second selecting circuit 320-S may output V9, V10, V11, and V12 according to bit signals of image data RGB of 1000, 1001, 1010, and 1011, respectively.

If image data RGB is 1100, 1101, 1110, and 1111, the second gamma reference voltage Vg_ref2 may be V14.5, and V13, V14, V15, and V16 may be generated as the gamma voltage Vg. The second selecting circuit 320-S may output V13, V14, V15, and V16 according to bit signals of image data RGB of 1100, 1101, 1110, and 1111, respectively.

What is claimed is:

1. A data driving device for driving pixels arranged in a display panel, the data driving device comprising:

a first selecting circuit configured to receive some bits of image data for driving the pixels and to select one of a plurality of voltages included in a first gamma reference voltage as a second gamma reference voltage according to the some bits;

a second voltage generating circuit configured to generate a plurality of gamma voltages by increasing or decreasing the second gamma reference voltage received from the first selecting circuit; and a second selecting circuit configured to receive remaining bits of the image data and to select one gamma voltage from among the plurality of gamma voltages received from the second voltage generating circuit as a data voltage for driving the pixels according to the remaining bits.

2. The data driving device of claim 1, further comprising a buffer configured to receive the one gamma voltage from the second selecting circuit, to amplify the one gamma voltage, and to output the amplified voltage as the data voltage.

3. The data driving device of claim 1, wherein the second voltage generating circuit is configured to increase or to decrease the second gamma reference voltage using a mirrored current.

4. The data driving device of claim 3, further comprising a bias circuit configured to supply a bias current to the second voltage generating circuit by generating a reference current and mirroring the reference current to the second voltage generating circuit.

5. The data driving device of claim 4, wherein the bias circuit is configured to receive some of the plurality of voltages included in the first gamma reference voltage and generate the reference current using the received some of the plurality of voltages.

6. The data driving device of claim 1, wherein the second voltage generating circuit comprises a plurality of resistor arrays, and is configured to increase the second gamma reference voltage by one resistor array and to reduce the second gamma reference voltage by another resistor array.

7. The data driving device of claim 6, wherein the second gamma reference voltage is applied to a node at which the one resistor array and the other resistor array meet.

* * * * *